United States Patent [19]

Bock

[11] Patent Number: 4,655,647

[45] Date of Patent: Apr. 7, 1987

[54] METHOD AND APPARATUS FOR THE ACCELERATION OF SOLID PARTICLES ENTRAINED IN A CARRIER GAS

[75] Inventor: André Bock, Luxembourg, Luxembourg

[73] Assignee: Arbed S.A., Luxembourg, Luxembourg

[21] Appl. No.: 730,383

[22] Filed: May 3, 1985

[30] Foreign Application Priority Data

May 15, 1984 [LU] Luxembourg ..... 85363

[51] Int. Cl.[4] ..... B65G 53/42

[52] U.S. Cl. ..... 406/194; 239/424; 239/590.5; 266/225; 406/154

[58] Field of Search ..... 406/154, 194, 195; 239/424, 590, 590.3, 590.5, 589; 266/216, 222, 225; 51/439

[56] References Cited

U.S. PATENT DOCUMENTS 3,747,859 7/1973 Gabel et al. ..... 239/424 X 3,876,190 4/1975 Johnstone et al. ..... 266/225

FOREIGN PATENT DOCUMENTS 2521253 11/1976 Fed. Rep. of Germany ..... 239/590

*Primary Examiner*—Jeffrey V. Nase

*Attorney, Agent, or Firm*—Fishman & Dionne

[57] ABSTRACT

An acceleration nozzle for particles entrained in a carrier gas comprises a first central nozzle having a first diverging cross-section, and an extension nozzle section extending from the first nozzle. The extension nozzle section has a flare or diverging angle which is greater than that of the first acceleration nozzle. The nozzle extension is surrounded about its mouth or opening by a second nozzle forming a casing or housing therearound; the second nozzle being connected to a source of gas. In a preferred embodiment, instead of utilizing two distinct gas sources to supply the first acceleration nozzle and the second "housing" nozzle, a portion of the gas passing through the acceleration nozzle may be diverted by means of slits built into the latter. The slits act as a separator of the gaseous phases and solid particles, and prevent the solid particles from penetrating the second nozzle. Acceleration nozzles of the present invention are typically used for delivering carboniferous powdered materials into a steel bath.

14 Claims, 1 Drawing Figure

METHOD AND APPARATUS FOR THE ACCELERATION OF SOLID PARTICLES ENTRAINED IN A CARRIER GAS

BACKGROUND OF THE INVENTION

This invention relates to a device for accelerating solid particles entrained in a carrier gas through a duct. More particularly, this invention relates to a new and improved acceleration nozzle for solid particles entrained in a carrier gas. Such acceleration nozzles are typically used for introducing carboniferous powdered materials into a steel bath.

The ratio of scrap iron or other cooling additives advantageously incorporated into a metal bath during the refinement process depends chiefly on the composition of the smelting material, the temperature of the charge and the thermodynamic development of the refining process. It will be appreciated that to reduce the cost or price of steel, it is important to increase the ratios of presently used additives by some 400 kg of scrap iron per ton of smelting. One of the known methods for increasing the amount of scrap during refining consists of increasing the level of postcombustion CO being given off from the bath, while insuring that the bath absorbs a maximum amount of the heat liberated therefrom. Another known method consists of heating the metallic bath by utilizing supplementary sources of energy. Techniques of addition of gas and combustible liquid are used with varying success. Also, techniques of addition of combustible material in the form of granules of carbureted matter have been developed. The incorporation of solid material in the bath may be accomplished from below (through nozzles or permeable elements positioned in the bottom of the converter), or from above the converter together with gaseous materials. Thus, in this last case (solid materials entrained in a carrier gas), in order to have a suitable absorption of the carbureted material by the bath, the solid carbureted material must have not only well established concentrations of oxygen and carbon, but in addition, the carbureted material must have sufficient kinetic energy and concentration at the outlet of the nozzle so as to penetrate the bath. The high kinetic energy is also required to avoid premature combustion of the carbureted material above the bath.

In patent application EP No .84630036 corresponding to U.S. patent application Ser. No. 587,540 now U.S. Pat. No. 4,603,810,assigned to the assignee hereof, and incorporated herein by reference, a device is described for the acceleration of solid particles suspended or entrained in a carrier gas. The device comprises a source of gas under pressure, means of obtaining the proper mixture of gas and solid particles together with delivery conduits for the gas/solid particle mixture opening into a nozzle. An important and novel feature of the nozzle disclosed in U.S. Pat. No. 4,603,810 is that at least a portion thereof has a cross-section which varies in a specific manner. This varying nozzle cross-section precludes the speed of the gas from increasing abruptly along the last few meters of the nozzle (as this relatively high gas speed can no longer be transmitted to the solid particles). By choosing nozzles or ducts that flare out, i.e., diverge, along the last meters before the mouth or exit opening, particle speeds of some 190 m/s have been obtainable at the mouth; the speed of the gas at that point being slightly less than the speed of sound.

Although the device described in U.S. Pat. No. 4,603,810 provides excellent results from the standpoint of particle speed and is therefore well suited for its intended purposes, it does suffer from several deficiencies and drawbacks. For example, it has been found that the depth of penetration of the solid particles into the bath is poor. Theoretical calculations show that the depth of penetration L of a jet of particles into a bath of liquid equals (without the presence of oxygen jets and for slight angles of divergence A and high concentrations of particles):

$$L = \left[ \frac{Q_c \cdot v_c}{20\pi \cdot g \cdot \rho_{ac} \cdot tg^2 A/2} + L_o^3 \right]^{\frac{1}{3}} - L_o \qquad (1)$$

where:

$Q_c$=particle discharge (kg/min);

$L_o$=height of the nozzle above the bath (m);

$v_c$=particle speed (m/s);

$\rho ac$=steel density (kg/m$^3$);

A=divergence angle of jet (degrees);

Blank tests in the atmosphere have shown that the angle A is contained between 4° and 7°, from which, with the aid of equation (1), a penetration depth L of from 15 to 50 cm. (with $Q_c$=300 kg/min, $v_c$=150 m/s, $L_o$=1.5 m) may be calculated.

However, under actual conditions, the real penetrations of solid particles are far from the ideal conditions that led to equation (1). Under real conditions, account must be taken of the fact that at the time of the recarburization:

(a) The vertical blast nozzle of the entrained mixture of gas and solid material is surrounded by several blast pipes of primary oxygen which induce an increase in the angle of divergence A of the gas/solid particle jet. The effect of the exhaust of the oxygen jets actually gives rise to a depressurization of the central area which is surrounded thereby, and in which the gas/solid particle jet moves. This jet, the static pressure of which at the mouth is of 1 bar, consequently undergoes an abrupt expansion causing a radial displacement of the particles and as a consequence thereof, a diminution of their concentration.

(b) Also, as the carrier gas travels through the liquid bath, the gas slows thereby creating a counter-current which enlarges the area of impact on the bath. As a result, the carrier gas does not enter into the steel bath. Instead, it is strongly decelerated at the surface of the bath, which results in a diminution of the dynamic pressure and a corresponding increase of the static pressure. A pressure gradient is established in the area contained between the oxygen jets and the central jet which is a generator of counter-currents absorbed progressively by the jets. These counter-currents reinforce the shearing action between the central jet and the atmosphere that surrounds it.

(c) Finally, the difference between the speed of the carrier gas (Approx. 320 m/s) and the particles (approx. 180 m/s) at the outlet of the nozzle creates additional micro-turbulences inside the jet.

It follows that the angle of divergence A of the jet of particles in the crucible must be distinctly greater than that observed in the blank tests. If A becomes greater than the limit value calculated below, $$A_{threshold} = 2\ arctg\left[\frac{\frac{\sqrt{Q_c \cdot \Delta t}}{10\pi\ \rho_c\ d_c} - d_o}{2\ L_o}\right]$$

where:

$\Delta t$ = "opening time" of the bath; and $d_o$ = outlet diameter of the nozzle.

shows that the actual or real depth of penetration L is no more than several centimeters.

SUMMARY OF THE INVENTION

The above discussed and other deficiencies of the prior art are overcome or alleviated by the device for accelerating solid particles entrained in a carrier gas of the present invention. In accordance with the present invention a nozzle is provided which limits the undesirable phenomena described under points (a) and (c) above; and which assures a high depth penetration of particles in the liquid bath (so long as the oxygen nozzles are arranged in suitable fashion around the nozzle).

The improved nozzle in accordance with the present invention comprises a first central nozzle having a first diverging cross-section (similar to the nozzle described in U.S. Pat. No. 4,603,810, and an extension nozzle section extending from the first nozzle. The extension nozzle section has a flare or diverging angle which is greater than that of the first acceleration nozzle. The nozzle extension is surrounded about its mouth or opening by a second nozzle forming a casing or housing therearound; the second nozzle being connected to a source of gas. In a preferred embodiment, instead of utilizing two distinct gas sources to supply the first acceleration nozzle and the second "housing" nozzle, a portion of the gas passing through the acceleration nozzle may be diverted by means of slits built into the latter. The slits act as a separator of the gaseous phases and solid particles, and prevent the solid particles from penetrating the second nozzle. Other variations of the present invention are described hereinafter.

The features and advantages of the present invention include obtaining a jet of carbureted matter of which the angle of divergence A is less than 2° (for blank tests). As long as A remains less than $A_{threshold}$ in the crucible, the theoretical depth of penetration will be approximately 2 m. Moreover, the supplementary gas jet of the second nozzle prevents a premature combustion of the granulated material above the metallic bath.

The above discussed and other advantages of the present invention will be apparent to and understood by those skilled in the art from the following detailed description and drawing.

BRIEF DESCRIPTION OF THE DRAWING

The single

DESCRIPTION OF THE PREFERRED EMBODIMENT

Figure 1:
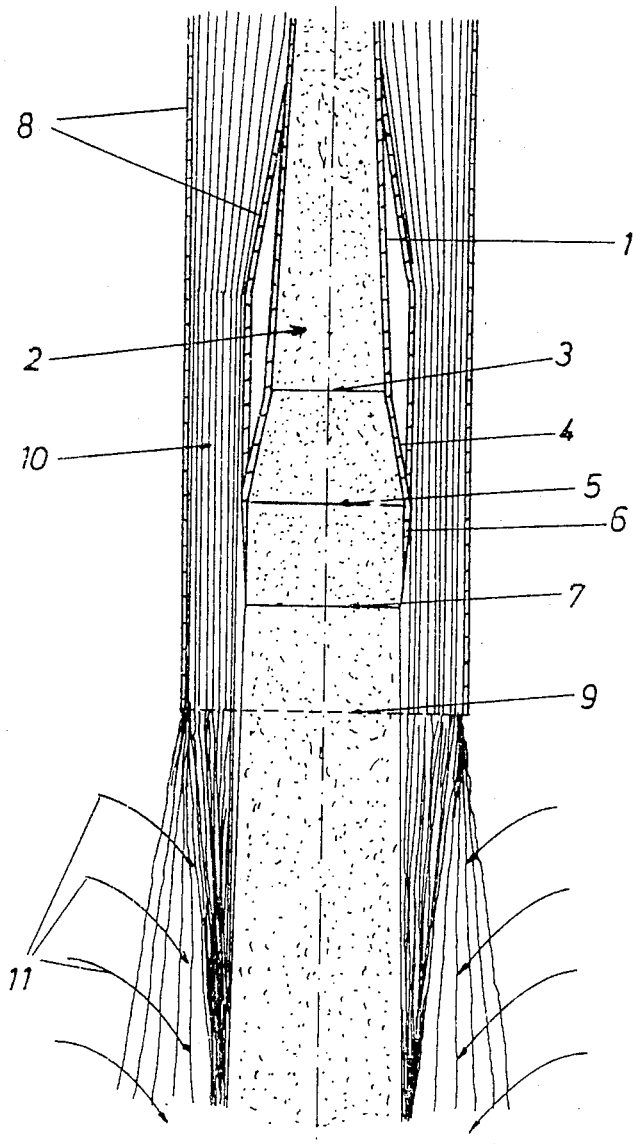
FIG. 1 is a cross-sectional elevation view showing one embodiment of the acceleration nozzle of the present invention.

Referring to FIG. 1, the nozzle 1 in accordance with the present invention is shown connected to a source of solid particles and gas; and provides a conduit for the passage of carrier gas/solid particles 2. At the mouth or opening 3 of the central nozzle 1, the carrier gas has a speed V1 greater than 300 m/s while the speed V2 of the granules of solid matter is less than 200 m/s.

An important feature of the present invention is a nozzle extension section 4 which is provided at the opening of nozzle 1. Preferably, extension section 4 has a truncated conical shape and a length of some twenty centimeters. The angle of flare or divergence of extension section 4 is greater than that of nozzle 1, preferably having a value of about 2° . The extension section 4 is mounted coaxially with central nozzle 1. Significantly, the cross-sectional difference between the top 3 and bottom 5 of the conical extension section 4 is chosen such that the speed of the carrier gas will be comparable to that of the solid particles at the mouth 5. Given the slight length of nozzle extension section 4, the speed of the solid particles will vary only very slightly. In essence then, the extension section 4 will act to slow down the speed of the carrier gas without affecting the speed of the solid particles entrained therein.

Another important feature of the present invention is the use of a second nozzle 8 concentric to the central nozzle 1, and forming a housing about the central nozzle. Second nozzle 8 includes parallel or cylindrical walls terminating at a mouth or opening 9, so as to obtain a parallel flow of gas 10. The gas 10 acts as a screen and is preferably identical to the carrier gas flowing through nozzle 1. Preferably, while passing between the parallel walls of second nozzle 8, gas 10 has a speed either very close to that of the carrier gas after the passage of the latter through the conical extension section 4, or has a supersonic speed (with the addition of an annular Laval nozzle). At the approach to the mouth 9 of the head of second nozzle 8, the carrier gas and the solid particles entrained therein have approximately the same speed. In order to avoid the extension section 4 from being the cause of turbulences in the gas 10 due to its divergent shape, it is advantageously extended by a cylindrical conduit portion 6, the wall of which preferably thins down toward its mouth 7.

In the preferred embodiment shown in FIG. 1, the opening or mouth 7 of cylindrical conduit portion 6, which guides the mixture of carrier gas/solid particles, is preferably spaced from the back of the mouth 9 of second nozzle 8 such that second nozzle 8 extends beyond first central nozzle 1 and nozzle extension section 4. At the time of refining, and between the phases of recarbureting with gas only (having a role of cooling and protection against splashings of slag and metal), the fact that portion 6 is spaced from mouth 9 allows blasting through conduit 8. The gas utilized therein may be neutral or oxidizing; when it is oxidizing, a light overpressure must be maintained inside the nozzle 1. During recarbureting phases, the choice of a neutral gas-screen is preferred.

In addition, the nozzle construction of the present invention may comprise several additional nozzles (not shown) for refining oxygen, arranged at equal distances around the central nozzle 1. These jets of refining oxygen are inclined at a predetermined angle $\alpha$ in relation to the axis of the nozzle. In a first area, close to the head of the nozzle, the blasting effect of the refining oxygen jets and the shearing waves 11 which result therefrom, primarily disturb the flow of screen-gas without drastically increasing the jet of carrier gas/solid particles, which therefore maintain their penetration properties. The angle $\alpha$ determines the extent of the second area characterized by the simultaneous presence of three (3) phases; gaseous, liquid and solid. Finally, they are all the parameters governing the form of this second area which is advantageous or disadvantageous to the dissolution of the carbon particles in the liquid steel in a third area, the upper limit of which is the surface of the bath of steel.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for accelerating solid particles entrained in a carrier gas through a duct comprising:

an exit section terminating at a first opening in said duct, said exit section diverging at a first angle and defining first nozzle means, said first nozzle means being adapted for connection to a source of gas and solid particles;

nozzle extension means attached to said first opening of said first nozzle means and terminating at a mouth, said nozzle extension means diverging at a second angle, said second angle being greater than said first angle wherein said gas and solid particles flow through said first nozzle means and said nozzle extension means;

second nozzle means surrounding said first nozzle means and said nozzle extension means, said second nozzle means being spaced from said first nozzle means and said nozzle extension means, said second nozzle means defining an annular housing about said first nozzle means and said nozzle extension means, said annular housing terminating at a second opening, and being adapted for connection to a gas source wherein gas flows through said second nozzle means, said annular housing having a first section of substantially constant predetermined cross-section followed by a second section of diverging cross-section followed by a third section of substantially constant cross-section terminating at said mouth of said nozzle extension means, said second nozzle means extending beyond said mouth of said nozzle extension means;

wherein said first nozzle means and said nozzle extension means are isolated from said second nozzle means whereby gas and solid particles flowing through said first nozzle means and nozzle extension means will be isolated from gas flowing through said second nozzle means; and wherein gas exiting said second opening of said second nozzle means provides a continuous gas screen to the gas and solid particles exiting said mouth of said nozzle extension means.

2. The device of claim 1 wherein:

said housing includes outer housing walls having a cylindrical shape.

3. The device of claim 1 wherein:

said nozzle extension means has the shape of a truncated cone.

4. The device of claim 3 wherein:

said nozzle extension means has a length of between about 10 to about 50 cm.

5. The device of claim 3 wherein:

said second diverging angle of said nozzle extension means is about 2 degrees.

6. The device of claim 3 including:

cylindrical extension means depending from said mouth of said nozzle extension means, said cylindrical extension means terminating at a third opening.

7. The device of claim 6 wherein:

said cylindrical extension means comprises a cylindrical wall, the thickness of said wall becoming thinner toward said third opening.

8. The device of claim 6 wherein:

said second opening of said second nozzle means extends beyond said third opening of said cylindrical extension means.

9. The device of claim 1 wherein:

said nozzle extension means has a length of between about 10 to about 50 cm.

10. The device of claim 1 wherein:

said second diverging angle of said nozzle extension means is about 2 degrees.

11. The device of claim 1 including:

cylindrical extension means depending from said mouth of said nozzle extension means, said cylindrical extension means terminating at a third opening.

12. The device of claim 11 wherein:

said cylindrical extension means comprises a cylindrical wall, the thickness of said wall becoming thinner toward said third opening.

13. The device of claim 11 wherein:

said second opening of said second nozzle means extends beyond said third opening of said cylindrical extension means.

14. A method for accelerating solid particles entrained in a carrier gas through a duct comprising:

providing an exit section terminating at a first opening in said duct, said exit section diverging at a first angle and defining first nozzle means;

connecting said first nozzle means to a source of gas and solid particles;

providing nozzle extension means attached to said first opening of said first nozzle means and terminating at a mouth, said nozzle extension means diverging at a second angle, said second angle being greater than said first angle;

delivering said gas and solid particles flow through said first nozzle means and said nozzle extension means;

providing nozzle means surrounding said first nozzle means and said nozzle extension means, said second nozzle means being spaced from said first nozzle means and said nozzle extension means, said second nozzle means defining an annular housing about said first nozzle means and said nozzle extension means, said annular housing terminating at a second opening wherein said first nozzle means and said nozzle extension means are isolated from said second nozzle means;

connecting said second nozzle means to a gas source wherein gas flows through said second nozzle means and whereby gas and solid particles flowing through said first nozzle means and nozzle extension means will be isolated from gas flowing through said second nozzle means; and wherein gas exiting said second opening of said second nozzle means provides a contiuous gas screen to the gas and solid particles exiting said mouth of said nozzle extension means.

* * * * *